United States Patent [19]

Pickell

[11] Patent Number: 4,926,162

[45] Date of Patent: May 15, 1990

[54] HIGH SECURITY COMMUNICATION LINE MONITOR

[75] Inventor: John D. Pickell, Roselle, Ill.

[73] Assignee: Honeywell Inc., Minneapolis, Minn.

[21] Appl. No.: 264,405

[22] Filed: Oct. 28, 1988

[51] Int. Cl.[5] ..... G08B 1/08

[52] U.S. Cl. ..... 340/534; 340/506; 340/513; 340/505; 340/533; 340/538; 340/531; 340/825.06; 340/825.29

[58] Field of Search ..... 340/505, 506, 531–536, 340/538, 512, 513, 825.06, 825.29, 825.43, 825.59

[56] References Cited

U.S. PATENT DOCUMENTS

| | | | |
|---|---|---|---|
| 3,707,708 | 12/1972 | Dan | 340/533 |
| 3,735,353 | 5/1973 | Donovan et al. | 340/534 |
| 4,023,163 | 5/1977 | Krishnaiyer et al. | 340/534 |
| 4,044,351 | 8/1977 | Everson | 340/533 |
| 4,254,410 | 3/1981 | Virkus | 340/534 |

*Primary Examiner*—Donnie L. Crosland

*Attorney, Agent, or Firm*—Donald J. Lenkszus

[57] ABSTRACT

A communication line monitor for use in a security or fire detection system of the type including a central alarm station and a communication line. A remote transmitter is coupled to the communication line at the remote end thereof and is assigned one unalterable preassigned address out of 6,561 different addresses. The remote transmitter continuously transmits an eight bit trinary code over the communication line corresponding to its preassigned address. A monitor located at the central alarm station is coupled to the communication line and indicates an alarm condition when the signals received from the remote transmitter fail to correspond to the remote transmitter's preassigned address. The monitor includes a plurality of switches to condition the monitor for identifying the remote transmitter's address. The switches are resettable to any other one of the different addresses. The remote transmitter also transmits a ninth bit which is used to verify a state of the communication line established by the central alarm station.

8 Claims, 2 Drawing Sheets

HIGH SECURITY COMMUNICATION LINE MONITOR

BACKGROUND OF THE INVENTION

The present invention is generally directed to a new and improved fire or security detection system. The present invention is more particularly directed to a communication line monitoring system for use in high security fire or security detection systems.

There are many applications in industry and commerce for fire and security detection systems. Such systems are employed, for example, in banks, industrial factories, or industrial research and engineering facilities.

Such systems generally include a plurality of remote fire or security sensors, such as motion detectors or normally closed switch contacts, used at places of access such as doors or windows. Such remote sensors are customarily coupled to a communication line which is also coupled to a central alarm station. The central alarm station monitors the condition of the communication line and issues an alarm indication when the condition of the communication line indicates that a fire has occurred or that a secured access point has been breached.

In high security systems, at the remote end of the communication line is a remote transmitter having a preassigned address which continuously transmits back to a monitor at the central alarm station a series of coded electrical signals corresponding to the preassigned address of the remote transmitter. The monitor is arranged to identify the preassigned address of the remote transmitter and, if an alarm condition associated with a communication line exists, the code or address received by the monitor will be different than expected. This can result for example, by a pair of normally open switch contacts associated with a given sensor shorting the communication line or by a pair of normally closed switch contacts opening the communication line.

In the past, the number of different codes or addresses which could be preassigned to a given remote transmitter has been limited because a binary transmission code has been used. Also, it is necessary for the monitor to be conditioned to identify the code of its associated remote transmitter. In the past, such monitors have been unalterably conditioned requiring replacement of the monitor when a remote sensor has been replaced with one having a different address.

The communication line customarily employed is a line pair having opposite polarity. Polarity reversal of the line pair has been used to switch the system from what is known as a secure state to what is known as an access state and vice versa. In the secure state, all remote sensors are activated. In the access state, customarily used during the day, some remote sensors can be deactivated by the polarity reversal to provide limited access to a secured area without provoking an alarm condition. For example, a sensor having a pair of normally closed contacts can have a diode coupled in parallel with it which is back biased in the secure state, thus activating the sensor, and forward biased by the polarity reversal in the access state, thus deactivating the sensor. In highly secure systems, it would be desirable for the central alarm station to be able to verify that the communication line is in the proper operating state.

Accordingly, it is a general object of the present invention to provide a new and improved fire or security detection system of the type including a central alarm station and at least one remote transmitter.

It is further general object of the present invention to provide a communication line monitor for a fire and security detection system which has a greater number of preassignable addresses for the remote transmitters.

It is a further object of the present invention to provide a communication line monitor for use in a fire or security detection system wherein the monitor, located at the central alarm station is resetable to any one of the other possible preassignable remote transmitter addresses or codes should a remote transmitter require replacement.

It is still a further object of the present invention to provide a communication line monitor wherein the secure or access state of the communication line can be confirmed by signals transmitted by the remote transmitter to the monitor of the central alarm station.

SUMMARY OF THE INVENTION

The invention therefore provides, in a security or fire detection system of the type including a central alarm station and at least one remote sensor coupled to the central alarm station by a communication line, a communication line monitor for monitoring the condition of the communication line. The communication line monitor includes a remote transmitter coupled to the communication line at the remote end thereof. The remote transmitter is assigned one unalterable preassigned address out of a predetermined number of different addresses and includes means for transmitting a series of electrical signals over the communication line corresponding to the one preassigned address. The communication line monitor further includes monitor means located at the central alarm station which is coupled to the communication line for indicating an alarm condition when the electrical signals received from the remote transmitter fail to correspond to the one preassigned address. The monitor means includes setting means for setting the monitor means to the one preassigned address to condition the monitor means for identifying the one preassigned address. The setting means is resetable to any other one of the predetermined number of different addresses.

The invention further provides in a security or fire detection system of the type including a central alarm station and at least one remote sensor coupled to the central alarm station by a communication line, a communication line monitor for monitoring the condition of the communication line. The communication line monitor includes a remote transmitter coupled to the communication line at the remote end thereof. The remote transmitter is assigned one unalterable preassigned address out of a predetermined number of different addresses and includes means for transmitting a series of electrical signals in the form of a multiple bit trinary code over the communication line corresponding to the one preassigned address. The communication line monitor further includes monitor means located at the central alarm station which is coupled to the communication line. The monitor means includes means for identifying the one preassigned address and means for indicating an alarm condition when the electrical signals received from the remote transmitter fail to correspond to the one preassigned address.

The invention still further provides in a security or fire detection system of the type including a central alarm station and a plurality of sensors coupled to the central alarm station by a communication line, wherein the system is selectively operable from the central alarm station to establish the communication line in a secure state wherein all remote sensors are activated or an access state wherein at least one of the remote sensors is deactivated, a communication line monitor for monitoring the condition of the communication line. The communication line monitor includes a remote transmitter coupled to the communication line at the remote end thereof. The remote transmitter is assigned one unalterable preassigned address out of a predetermined number of different address and includes means for transmitting a series of electrical signals over the communication line corresponding to the one preassigned address and to the secure or access state of the communication line. The communication line monitor further includes monitoring means located at the central alarm station which is coupled to the communication line for indicating an alarm condition when the electrical signals received from the remote transmitter fail to correspond to the one preassigned address or to the state of the communication line established by the central alarm station.

BRIEF DESCRIPTION OF THE DRAWINGS

The features of the present invention which are believed to be novel are set forth with particularity in the appended claims. The invention, together with further objects and advantages thereof, may be best understood by making reference to the following description taken in conjunction with the accompanying drawings, in the several figures of which like reference numerals identify like elements, and in which:

DESCRIPTION OF THE PREFERRED EMBODIMENT

Figure 1:
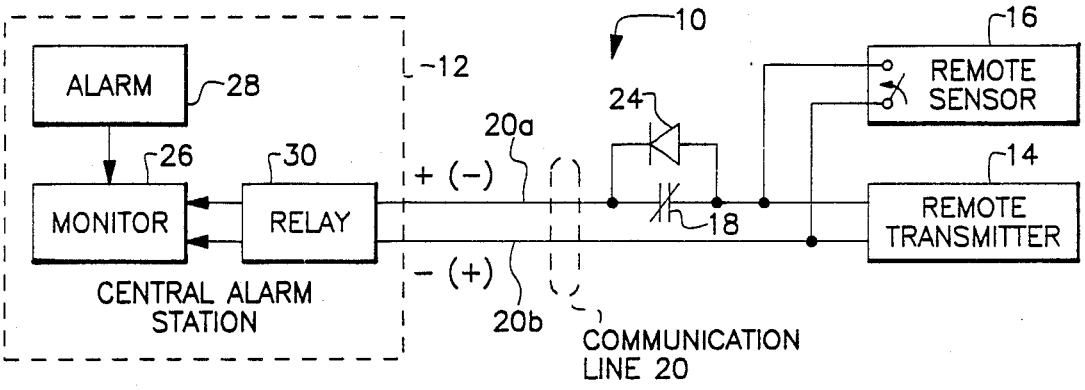
FIG. 1 is a block diagram of a fire or security detection system embodying the present invention.

Referring now to FIG. 1, it illustrates a fire or security detection system 10 embodying the present invention. The system 10 generally includes a central alarm station 12, a remote transmitter 14, and remote sensors 16 and 18. The remote transmitter 14 is coupled to the central alarm system 12 by a communication line 20 which includes a line pair including a line 20*a* and another line 20*b*.

As can be noted from FIG. 1, the remote sensor 16 includes a pair of normally open contacts 22 which are coupled across the line pair formed by lines 20*a* and 20*b*. The remote sensor 18 takes the form of a pair of normally closed contacts which are coupled in series with the line 20*a*. Coupled across the remote sensor 18 is a diode 24.

Central alarm station 12 includes a monitor 26, an alarm 28, and a relay 30. Relay 30 is utilized to reverse the polarity of the lines 20*a* and 20*b*. When the line 20*a* is of positive polarity with respect to line 20*b*, the system is established in the secure state. When the line 20*a* is of negative polarity with respect to the line 20*b*, as indicated by the parenthesis, the system is established in the access state. When the system is in the secure state, all of the remote sensors of the system are activated. However, when the system is established in the access state, at least one of the remote sensors is deactivated. In the case of the system illustrated in FIG. 1, when the system is established in the access state, the diode 24 will be forward biased to deactivate the sensor 18. The access state of security systems is generally utilized during those times in which the protected premises is occupied by personnel. The remote sensor 18 could, for example, be an access sensor on a door, for example, which is generally utilized during the day, but is to be rendered secured at night when the premises is unoccupied.

Relay 30 couples the communication line 20 to the monitor 26. In accordance with the present invention, the remote transmitter 14 transmits a series of electrical signals which take the form of a multiple bit code corresponding to a preassigned address of the remote transmitter 14. The remote transmitter 14 is assigned an unalterable preassigned address which, according to this preferred embodiment, may be a four digit address, wherein each digit has a value between 0 and 8. As a result, the remote transmitter can be preassigned an unalterable address out of a possible 6,561 addresses.

The remote transmitter transmits its address over the communication line 20 including the line pair 20*a* and 20*b*, through the relay 30 and to the monitor 26. The address of the remote transmitter 14 is transmitted in the form of an 8 bit trinary code wherein each bit is a high (logical 1), a low (logical 0) or an open. Each bit of the 8 bit trinary code is made up of a pair of pulses, wherein a high is represented by a pair of high pulses, a low is represented by a pair of low pulses, and an open is represented by one high and one low pulse. As will be described subsequently, the remote transmitter 14 transmits, with its address, a ninth bit which is a binary bit having a high or low value corresponding to the secure state or access state established on the communication line 20.

Figure 3:
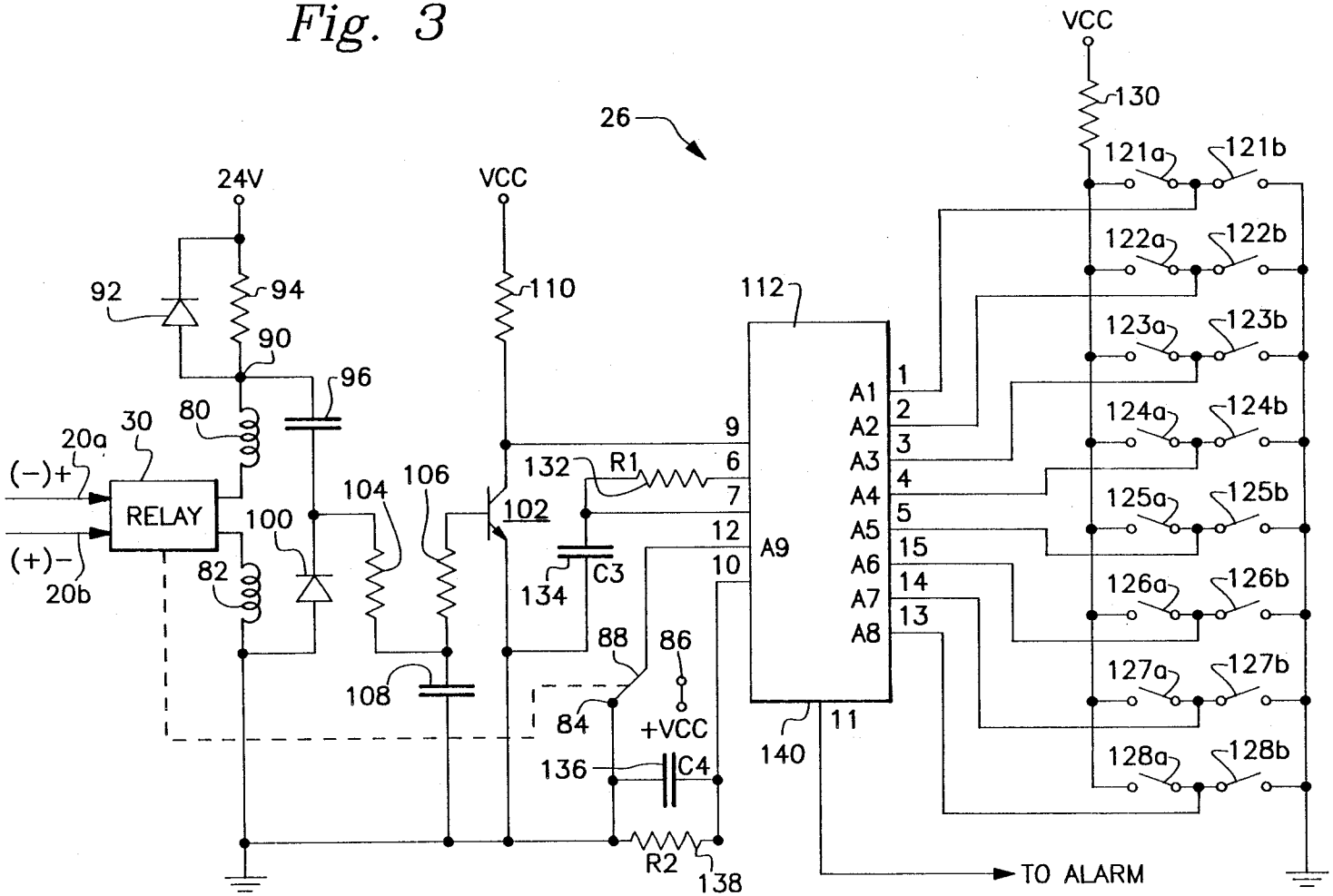
FIG. 3 is a schematic circuit diagram of a monitor embodying the present invention which may be utilized in the system of FIG. 1.

The monitor 26 within the central alarm station 12 receives the multiple bit code from the remote transmitter. The monitor 26, as will be described in greater detail with respect to FIG. 3, is conditioned to identify the address of the remote transmitter 14. If the electrical signals received by the monitor 26 from the remote transmitter 14 fail to correspond to the address of the remote transmitter 14, the monitor 26 indicates an alarm condition providing a suitable voltage to the alarm 28 to cause an alarm condition. The alarm 28 can be, for example, a light emitting diode which lights up, a bell ringer, or any other such alarm indicator well known in the art.

The remote transmitter 14 is arranged for continuously and repetitively transmitting electrical signals in the form of the multiple bit code corresponding to its address on the communication line 20. An alarm condition is sensed by the monitor 26 when, for example, contacts 22 of remote sensor 16 close thus shorting communication line 20, or when the normally closed contacts 18 open to open the communication line 20.

As previously explained, the first 8 bits of the multiple bit code transmitted by the remote transmitter 14 correspond to its unalterable preassigned address. The ninth bit corresponds to the state of the communication line 20. The ninth bit is sent by the remote transmitter in the same format as the other 8 bits but is a binary bit because the open condition is not utilized. The ninth bit is set by the polarity of the line 20*b*. As a result, when the communication line 20 is in the secure state, the ninth bit will represent a low (logical 0). Conversely, when the communication line 20 is in the access state, the ninth bit will represent a high (logical 1).

The relay 30 is under the control of the central alarm station which establishes the state of the communication line 20. The remote transmitter transmits the ninth bit in response to the state of the communication line 20 and the ninth bit transmitted by the remote transmitter is utilized by the monitor 26 for verifying the state of the communication line 20. This precludes undetected tampering with the state of the communication line 20 externally to the central alarm station. If the ninth bit transmitted by the remote transmitter 14 does not correspond to the expected state established by the central alarm station, the monitor 26 will indicate an alarm condition.

As previously mentioned, the monitor 26 is conditioned to identify the unalterable preassigned address of the remote transmitter 14. As will be seen hereinafter, the monitor 26 includes a plurality of switches which can be set to condition monitor 26 for identifying any one of the 6,561 possible remote transmitter addresses. The switch means of the monitor 26 can be reset to any one of these addresses to permit replacement of a remote transmitter without requiring replacement of the monitor 26.

Figure 2:
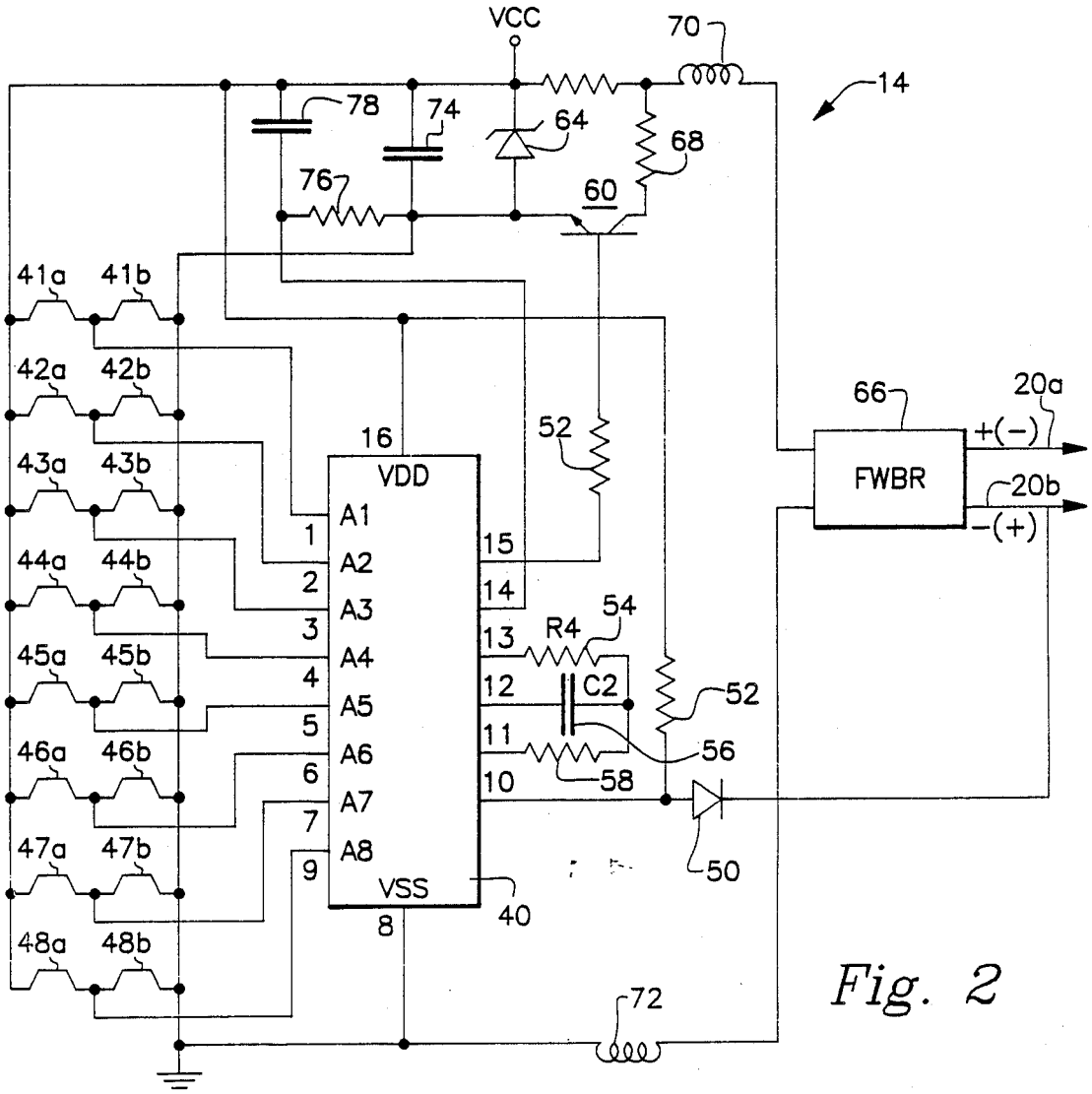
FIG. 2 is a schematic circuit diagram of a remote transmitter embodying the present invention which may be utilized in the system of FIG. 1.

Referring now to FIG. 2, it illustrates in schematic diagram form a remote transmitter 14 embodying the present invention. At the heart of the remote transmitter is an integrated circuit 40 which is a commercially available Motorola MC 145026P integrated circuit. For convenience, the various pin numbers of integrated circuit 40 are illustrated externally to the integrated circuit and should not be confused with any reference characters utilized in the drawings.

The integrated circuit 40 includes a plurality of inputs designated A1 through A8. It is at these inputs that the unalterable preassigned address of the remote transmitter is established. As can be seen from FIG. 2, each such input is coupled to a pair of wire jumpers. For example, input A1 is coupled to wire jumpers 41*a* and 41*b*, input A2 is coupled to wire jumpers 42*a* and 42*b*, and this relation continues through input A8 which is coupled to jumper wire 48*a* and 48*b*.

In establishing the 8 bit trinary code corresponding to the address of the remote transmitter, the wire jumpers are selectively cut open. For example, if the first bit of the address corresponding to A1 is to be a low, jumper wire 41*a* is cut open and jumper wire 41*b* is left intact to couple input A1 to ground potential. If the first bit is to be a high, jumper wire 41*b* is cut and jumper wire 41*a* is left intact to couple the positive power supply voltage (VCC) to input A1. If the first bit is to be an open, then both jumper wires 41*a* and 41*b* are cut to create an open condition at input A1. The foregoing programming continues for all eight inputs of the integrated circuit 40 in correspondence to the 8 bit trinary code to be transmitted by the remote transmitter 14 on the communication line 20 formed by lines 20*a* and 20*b*.

The ninth bit of the multiple bit code transmitted by the remote transmitter 14 is set by the state of the communication line and more specifically by the polarity of the line 20*b*. To that end, it will be noted that the input designated A9 is coupled to line 20*b* by a diode 50. The input A9 is also coupled to the positive voltage supply (VCC) by a resistor 52. As a result, when line 20*b* is negative, indicating that the communication line is in the secure state, the diode 50 will be forward biased placing the input A9 at a low voltage level to cause the ninth bit transmitted to be a low level. If line 20*b* is positive, diode 50 will be back biased and the resistor 52 will couple input A9 to the positive power supply voltage to cause input A9 to be at a high level. As a result, the ninth bit will be represented by a high level to indicate that the communication line is in the access state.

In addition to the foregoing, the transmitter includes a resistor 54 and a capacitor 56 which are designated R4 and C2, respectively. The resistor 54 and capacitor 56 are coupled together at one end, the resistor 54 at its other end is coupled to pin 13 of integrated circuit 40 and the capacitor 56 at its other end is coupled to pin 12 of the integrated circuit 40. The combination of resistor 54 and capacitor 56 sets the frequency or timing the remote transmitter. Another resistor 58 is coupled at one end to the common connection of resistor 54 and capacitor 56 and at its other end to pin 11 of the integrated circuit 40.

The output of integrated circuit 40 is at pin 15 which is coupled to the base of a transistor 60 by a resistor 62. The emitter of transistor 60 is maintained at ground potential. A zener diode 64 is coupled between the emitter of transistor 60 and the positive voltage supply. The collector of transistor 60 is coupled to a full-wave bridge rectifier 66 through a resister 68 and a static protection choke 70. Choke 70 is then coupled to the full-wave bridge rectifier. The other side of the full-wave bridge rectifier 66 is coupled to ground potential through another static protection choke 72.

Capacitor 74 is coupled across the zener diode 64 and serves as a filter capacitor. The combination of resistor 76 and capacitor 78 provide an RC timing network coupled to pin 14 of integrated circuit 40 to provide an initial startup pulse to the transmitter enable input of the integrated circuit.

Hence it can be seen that the electrical signals transmitted by the remote transmitter are transmitted along the lines 20*a* and 20*b*. As will be explained subsequently, the electrical signals transmitted on communication line 20 vary between a level of 18 volts for a low and 22 volts for a high. When communication line 20 is in the secure state, line 20*a* will be positive with respect to the line 20*b* and when the communication line 20 is in the access state, the line 20*b* will be positive with respect to the line 20*a*.

Referring now to FIG. 3, it illustrates in schematic circuit diagram form a monitor 26 which may be utilized in practicing the present invention as illustrated in FIG. 1. The monitor is arranged to be coupled to the communication line 20, and more specifically to lines 20*a* and 20*b* which comprise the communication line. The lines 20*a* and 20*b* are coupled to the relay 30 which is also illustrated in FIG. 1 and which provides the polarity reversal of the communication line when the communication line is switched from the secure state to the access state or from the access state to the secure state. When establishing the communication line in the secure state, the relay 30 selectively couples the line 20*a* to the input of choke 80 and the line 20*b* to the input choke 82. When the communication line is in the access state, the relay 30 selectively couples the line 20*a* to the input of choke 82 and line 20*b* to the input of choke 80. As also illustrated, the relay 30 can include another pair of contacts 84 and 86 having an associated pole 88. The contact 84 is coupled to ground potential and the contact 86 is coupled to a positive voltage (VCC). When the relay 30 establishes the communication line in the secure mode, the pole 88 will be in contact with the contact 84 as illustrated. When the relay 30 establishes the communication line in the access mode, pole 88 will be in contact with the contact 86. This arrangement, as will be more fully described hereinafter, conditions the monitor for receiving the ninth bit of the code transmitted by the remote transmitter for properly verifying the secure or access state of the communication line.

The electrical signals transmitted by the remote transmitter are received at the common node 90 of diode 92, resistor 94, and capacitor 96. The diode 92 and resister 94 are coupled between the node 90 and a positive 24 volt power source. It is this 24 volt power source which biases the communication line so that the transitions between the high and low bit levels will be in a range of 22 and 18 volts, respectively. The capacitor 96 provides level shifting so that the electrical signals of the multiple bit code vary between 4 and 0 volts at the node 98. Coupled between this node 98 and ground is a diode 100.

The 0 volt low and 4 volt high pulses comprising the trinary code originated at the remote transmitter are impressed upon the base of a transistor 102 through a high frequency filtering network which includes resistor 104, resister 106, and a capacitor 108. The emitter of the transistor 102 is coupled to ground and the collector of the transistor 102 is coupled to VCC (5 volts) by a resistor 110. The collector of transistor 102 provides the trinary code to an input identified as pin number 9 on an integrated circuit 112.

The integrated circuit 112 is preferably, in accordance with this preferred embodiment, a commercially available Motorola MC 145028P. The pin numbers of the integrated circuit 112 are illustrated externally to the integrated circuit 112 and these pin numbers should not be confused with any of the reference characters used in the drawings.

The integrated circuit 112 has a plurality of inputs identified as A1 through A9 which are the inputs to the integrated circuit 112 which conditions the monitor 26 to identify the preselected unalterable address of the remote transmitter corresponding to the 8 bit trinary code and the ninth binary bit corresponding to the state of the communication line. To that end, it will be noted that a pair of switches is associated with each respective one of the inputs A1 through A8. For example, switches 121*a* and 121*b* are associated with the input A1. Each of the other inputs A2 through A8 is associated with its own pair of switches as illustrated in the circuit diagram of FIG. 3. Each switch is a two-position switch and because there are two such switches associated with each of the 8 inputs, there are a total of 16 two-position switches. Each of the switches 121*a* through 128*a* has a contact which is coupled to VCC through a resistor 130. Each of the switches 121*b* through 128*b* has a contact coupled to ground potential. The poles of the associated pair of switches are coupled together and to their respective input on the integrated circuit 112. The switches 121*a* through 128*a* and 121*b* through 128*b* provide the same function as the wire jumpers illustrated in FIG. 2. For example, if the first bit of the multiple bit trinary code transmitted by the remote transmitter is to be a high (logical 1), switch 121*a* will be closed and switch 121*b* will be open. If the first bit is to be a low (logical 0), switch 121*a* will be open and switch 121*b* will be closed. If the first bit is to be an open, both switches 121*a* and 121*b* will be open. As a result, each of the switches can be selectively closed or open to condition the monitor 26 to identify the preassigned unalterable address of the remote transmitter illustrated in FIG. 2. In addition, each of the switches 121*a* through 128*a* and 121*b* through 128*b* are resettable to any other one of the predetermined number of different addresses which could be assigned to the remote transmitters. As a result, should the remote transmitter associated with the monitor 26 require replacement, the monitor 26 can be reset by the selective opening and closing of the switches to accommodate the different address of a replacement remote transmitter. Obviously, by this arrangement, the monitor 26 can be adapted to properly function with any remote transmitter to be used in the system.

As previously mentioned, the ninth bit of the multiple bit code is a binary bit having a low or high value representative of the state of the communication line. The integrated circuit 112 is conditioned to identify the ninth bit as a result of the setting of the pole 88 to contact either the contact 84 or the contact 86. When the communication line is in the secure state, the pole 88 will be in contact with the grounded contact 84. When the communication line is in the access state, the pole 88 will be in contact with the contact 86 which is coupled to VCC. The pole 88 is coupled to the A9 input of the integrated circuit 112 to provide the integrated circuit with the proper voltage level representative of the desired state of the communication line.

To complete the description of the monitor 26 of FIG. 3, the monitor 26 includes timing components including resistor 132 (R1), capacitor 134 (C3), resistor 138 (R2) and capacitor 136 (C4). Resistor 132 is coupled between integrated circuit pin number 6 and the capacitor 134. The capacitor 134 is coupled between resistor 132 and the resistor 138. The resistor 138 is coupled in parallel with capacitor 136 between ground potential and pin 10 of the integrated circuit. Lastly, the junction of resistor 132 and capacitor 134 is coupled to pin 7 of the integrated circuit.

The timing components identified above are selected to provide a timing match between the remote transmitter and the monitor. Referring for the moment to FIG. 2, it will be noted that the remote transmitter includes timing components including resistor 54 (R4) and capacitor 56 (C2). The values of resistors R1 and R2 and the capacitors C3 and C4 of the monitor should be selected relative to the values of resistor R4 and capacitor C2 of the remote transmitter in accordance with the following relationships:

$$R1C3 = 3.95R4C2$$

$$R2C4 = 77R4C2$$

When the values of the timing components are selected in accordance with the above expressions, the timing of the remote transmitter will be matched to the timing of the monitor. This assures that the multiple bit code transmitted by the remote transmitter will be properly received by the monitor. As previously mentioned, the first eight bits comprise a trinary code and the ninth bit comprises a binary code. The ninth bit is actually a trinary code but the open condition is not utilized thereby rendering the ninth bit a binary code.

In operation, the remote transmitter 14 is arranged to continuously and repetitively transmit its address using the eight bit trinary code and the state of the communication line using the ninth binary bit over the communication line 20. The monitor 26 receives the transmitted multiple bit code and compares each bit received to the corresponding bit established by the switches 121*a* through 128*a* and 121*b* through 128*b* at the inputs A1 through A8 and the ninth bit to the voltage level at input A9. As long as all of the bits match, the output 140 of the integrated circuit 112 will remain high. However, should one of the bits not match, as for example if the wrong address was transmitted, the output 140 of integrated circuit 112 will go low to initiate an alarm condition. Such an alarm condition can be provided by the lighting of a light emitting diode or by the actuation of an audible device such as a bell ringer.

As previously mentioned with respect to FIG. 1, an alarm condition can also be caused by one of the remote sensors interrupting the communication line 20. This could be the result of, for example, the normally opened contacts 22 of remote sensor 16 closing to shorten the line or by the normally closed contacts 18 opening to open the line. As a result, the monitor of the present invention continuously monitors the condition of the communication line.

With respect to the ninth bit, which as previously mentioned is used to verify the state of the communication line, because the remote transmitter sets the transmitted ninth bit in response to the actual negative or positive state of the line 20*b* of the communication line 20, the ninth bit is received by the monitor to verify the state of the communication line. Because the ninth bit in the monitor is set by the central alarm station, if tampering of the communication line occurred, this condition will be detected by the monitor.

From the foregoing, it can be seen that the present invention provides a new and improved communication line monitor for use in a security or fire detection system. Because the setting means for the monitor, to condition the monitor to identify the preassigned unalterable address of its associated remote transmitter, is comprised of resettable switches, the monitor need not be replaced if the remote transmitter requires replacement. All that is required is that the switches be reset to the address of the new remote transmitter. In addition, because a trinary code is utilized for transmitting the address of the remote transmitter, the predetermined number of different possible addresses for the remote transmitter is increased to 6,561 possible addresses which is much greater than the number of addresses possible if a binary code were utilized. Lastly, because the remote transmitter senses the state of the communication line and sets its ninth bit in response thereto, the monitor at the central alarm station is capable of verifying the state of the communication line and initiating an alarm condition should the state of the communication line not correspond to the state established by the central alarm station.

While a particular embodiment of the present invention has been shown and described, modifications may be made and it is therefore intended in the appended claims to cover all such modifications as may fall within the true spirit and scope of the invention.

I claim:

1. In a security or fire detection system of the type including a central alarm station and a plurality of remote sensors coupled to said central alarm station by a communication line comprised of a pair of lines, said system being selectively operable from said central alarm station to establish said communication line in a secure state wherein all remote sensors are activated or an access state wherein at least one of said remote sensors is deactivated, a communication line monitor for monitoring the condition of said communication line, comprising:

a remote transmitter coupled to said communication line at the remote end thereof, said remote transmitter being assigned one unalterable preassigned address out of a predetermined number of different addresses and including means for transmitting a series of electrical signals over said communication line corresponding to said one preassigned address and to the secure or access state of said communication line;

monitor means located at said central alarm station and being coupled to said communication line for indicating an alarm condition when the electrical signals received from said remote transmitter fails to correspond to said one preassigned address or to the state of said communication line established by said central alarm station;

means for maintaining said pair of lines opposite in polarity; and means for reversing the polarity of said pair of lines when changing said communication line from one of said states to the other said state.

2. A communication line monitor as defined in claim 1 wherein said remote transmitter transmitting means includes means for transmitting said electrical signals in the form of a multiple bit code including a plurality of bits corresponding to said one preassigned address and at least one additional bit set in response to the secure or access state of said communication line.

3. A communication line monitor as defined in claim 2 wherein said at least one additional bit is one bit.

4. A communication line monitor as defined in claim 3 wherein said one bit is a binary bit.

5. A communication line monitor as defined in claim 4 wherein said plurality of bits comprise eight bits.

6. A communication line monitor as defined in claim 5 wherein said eight bits are trinary bits.

7. A communication line monitor as defined in claim 3 wherein said one bit is the last bit of said multiple bit code.

8. A communication line monitor as defined in claim 2 wherein said transmitting means is arranged for continuously and repetitively transmitting said multiple bit code.

* * * * *